US007255176B2

(12) United States Patent
Adam et al.

(10) Patent No.: US 7,255,176 B2
(45) Date of Patent: Aug. 14, 2007

(54) METHOD FOR REDUCING DIAMETER REDUCTION NEAR ENDS OF EXPANDED TUBULARS

(75) Inventors: Mark K. Adam, Houston, TX (US); Robert S. O'Brien, Katy, TX (US); Michael A. Carmody, Houston, TX (US); Mathew J. Jabs, Houston, TX (US); David A. Garcia, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 428 days.

(21) Appl. No.: 10/455,466

(22) Filed: Jun. 5, 2003

(65) Prior Publication Data

US 2004/0244979 A1 Dec. 9, 2004

(51) Int. Cl.
*E21B 29/00* (2006.01)

(52) U.S. Cl. ..... 166/380; 166/384

(58) Field of Classification Search ..... 166/380, 166/384, 206, 207, 242.1, 242.6, 387, 378; 285/382, 258, 382.4, 382.5; 138/109; 72/370.08
See application file for complete search history.

(56) References Cited

U.S. PATENT DOCUMENTS

| | | | | |
|---|---|---|---|---|
| 2,623,570 A | | 12/1952 | Resser | |
| 3,712,376 A | | 1/1973 | Owen et al. | |
| 3,746,091 A | | 7/1973 | Owen et al. | |
| 5,105,883 A | * | 4/1992 | Bode | 166/242.1 |
| 6,155,092 A | | 12/2000 | Sahlem | |
| 6,354,373 B1 | | 3/2002 | Vercaemer et al. | |
| 6,412,324 B2 | | 7/2002 | Sahlem | |
| 6,607,220 B2 | * | 8/2003 | Sivley, IV | 285/382 |
| 6,702,029 B2 | * | 3/2004 | Metcalfe et al. | 166/378 |
| 6,953,141 B2 | * | 10/2005 | Haugen | 166/380 |

FOREIGN PATENT DOCUMENTS

| | | |
|---|---|---|
| GB | 2365040 A | 2/2002 |
| WO | WO 96/37680 | 11/1996 |
| WO | WO 02/095181 A1 | 11/2002 |
| WO | WO 03/046334 A1 | 6/2003 |

* cited by examiner

*Primary Examiner*—Lanna Mai
*Assistant Examiner*—Matthew J. Smith
(74) *Attorney, Agent, or Firm*—Steve Rosenblatt

(57) ABSTRACT

A variety of approaches to reducing or eliminating "end effect" or the tendency of tubular ends to reduce in diameter after expansion are disclosed. Some involve pre-bending the ends outwardly while others involve removing material internally or/and externally near the ends. Yet other approaches feature weakening the ends in other ways including penetration of the tubular material using openings of various shapes including slots or/and holes where the openings are between the tube ends or where they can extend on one or both ends all the way to the end of the tubular. Inserts that are softer than the tube material can be placed near the ends. If there is an end effect, then the protruding material can be pushed out of the way or broken off.

26 Claims, 7 Drawing Sheets

METHOD FOR REDUCING DIAMETER REDUCTION NEAR ENDS OF EXPANDED TUBULARS

FIELD OF THE INVENTION

The field of this invention relates to combating the tendency of expanded tubulars to decrease in drift diameter from the finished expanded diameter at the ends of the tubulars.

BACKGROUND OF THE INVENTION

Expanding tubulars has come in vogue in many downhole applications. In a monobore well the finished size of the casing is the same. This is accomplished by inserting casing of a given size and expanding it downhole into a sealing relationship with the previous length of casing already in the bore so that a constant internal clearance diameter, known as drift diameter, is maintained. The drift diameter controls the size of tools that may later be advanced through the expanded tubular string. There are many other applications of expansion technology. Liner strings are hung on casing. Patches for cracked or broken casing or liner are patched with sleeves expanded downhole. Gravel pack screens are expanded to eliminate the annular space previously used for depositing gravel to retard production of sand.

With the ever-increasing use of expanding techniques there comes an undesirable side effect that has not been addressed. As a result of expansion of a given length of tube to a predetermined inside diameter using a swage, for example, the ends of the tubular tended to curl or flex inwardly toward the center of the expanded tubular. This phenomenon will reduce the drift diameter. This reduction in drift diameter could create a variety of problems. It could reduce production rates. It could make it impossible to pass certain tools to a desired location. It could create erosion areas where a portion of the tubular extended into the flowing stream that may eventually lead to tubular leakage. This reduction of the drift diameter as a result of expansion is referred to as the "end effect" in this application.

The present invention seeks to minimize or eliminate this end effect in several ways. One approach is to weaken the end in a variety of ways to counteract the forces acting on it to make it bend in after expansion. Another approach of the present invention is to pre-bend the ends outwardly so that the end effect nets a result of no reduction in drift diameter. Another approach of the present invention is to employ a soft material near the ends during swaging. Thereafter, even if there is some end effect, the material reducing the drift diameter is soft enough so that flow or a tool that needs to pass simply removes or cuts off any of the soft material that stands in the way. These and other approaches to minimizing or otherwise dealing with the end effect issue will be more readily apparent to those skilled in the art from a review of the description of the preferred embodiment and the claims, which appear below.

Generally related to the field of expanding sleeves in tubulars or expanding tubular ends are U.S. Pat. No. 2,623,570; 3,712,376; 3,746,091; 6,155,092 and 6,412,324. Of these, the most relevant is the '091 patent FIGS. 5 and 9 showing overlapping flexible fingers 55 at the end of a tubular sleeve 13 being expanded and at the end of a hold down sleeve 57. These overlapping fingers are pushed out to let the swage 15 pass and then spring back to their original position as described at Column 4 Lines 42-50. This application does not deal with end effect issues.

SUMMARY OF THE INVENTION

A variety of approaches to reducing or eliminating "end effect" or the tendency of tubular ends to reduce in diameter after expansion are disclosed. Some involve pre-bending the ends outwardly while others involve removing material internally or/and externally near the ends. Yet other approaches feature weakening the ends in other ways including penetration of the tubular material using openings of various shapes including slots or/and holes where the openings are between the tube ends or where they can extend on one or both ends all the way to the end of the tubular. Inserts that are softer than the tube material can be placed near the ends. If there is an end effect, then the protruding material can be pushed out of the way or broken off.

DETAILED DESCRIPTION OF THE DRAWINGS

DETAILED DESCRIPTION OF THE PREFERRED EMBODIMENT

The present invention seeks to minimize or eliminate end effects resulting from tubing expansion. The end effect is believed to occur is that as a result of high hoop stresses throughout the tubular induced during expansion. For all sections of the tubular not at an end, the section receives support from both sides. Sections at the tubular's ends are supported on only one end. The high hoop stresses are able to overcome this one sided support and deform the tubular inward, reducing the drift diameter.

Figure 1:
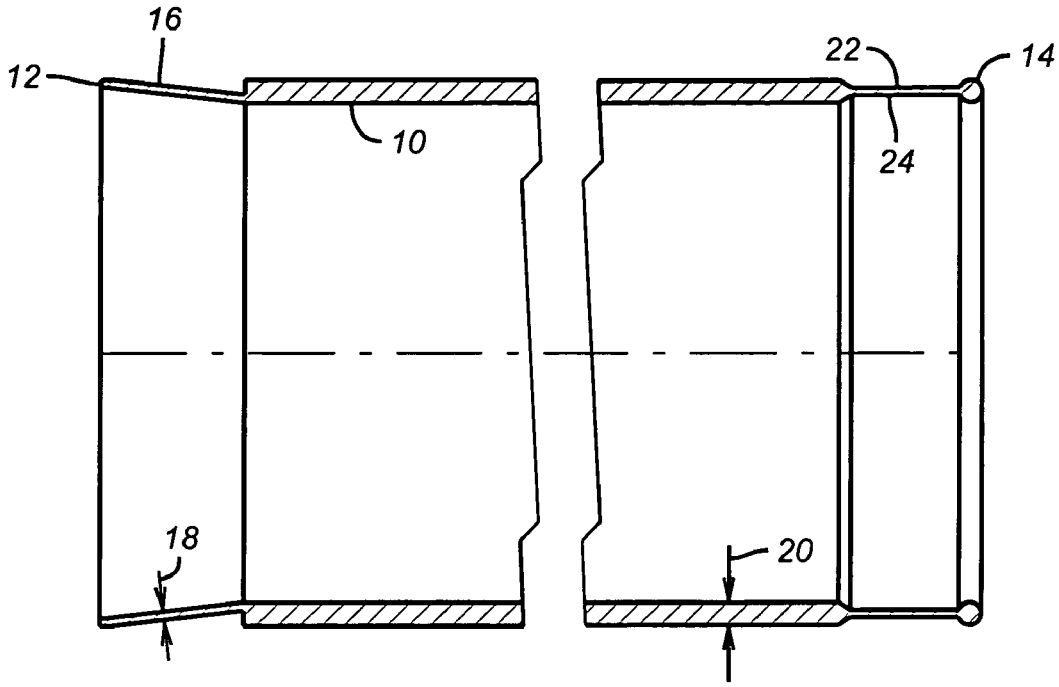
FIG. 1 is a section view of a tubular showing one end bent outwardly and the other having a groove internally and externally.

The Figures illustrate several approaches to combat this effect. These approaches can be mixed and matched and different approaches can be used at opposed ends. In FIG. 1, the left end is pre-bent outwardly before expansion. After expansion, even if there is an end effect, the pre-bending counteracts it so that the resultant end drift diameter is at least as large as the drift diameter 10 between the ends 12 and 14. The end 12 can be bent outwardly a few degrees or as much as about 15° depending on the length of bent segment 16. The thickness 18 of segment 16 is initially smaller than the thickness 20 for the rest of the tubular. At end 14 there is an outer recess 22 and an opposed inner recess 24. One or both of these recesses 22 and 24 serve to weaken the end so that when the swage or other expansion device is passed through end 14, the residual hoop stresses are minimized or the bending outward during expansion becomes sufficiently extreme so as to not have the driving force behind it to make end 14 collapse inwardly to a sufficient degree to reduce the drift diameter at the ends smaller than the balance of the tubular. While there may be some tendency of the end 14 to bend back toward the center of the tubular, such movement will be too insignificant to create a drift diameter reduction at that end.

Figure 2:
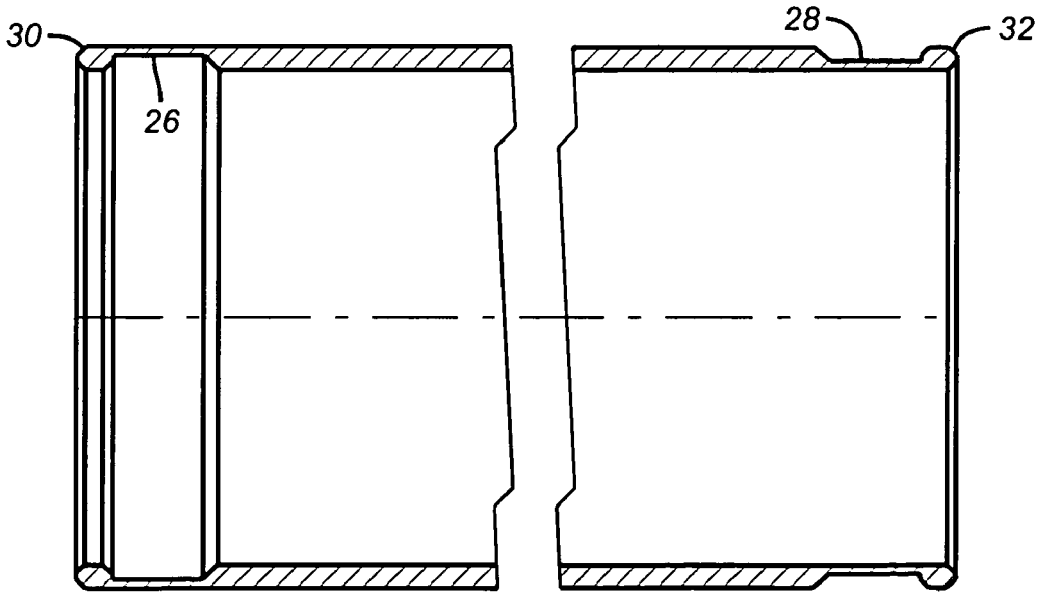
FIG. 2 shows, in section, an internal groove at one end and an external groove at the other end.

FIG. 2 shows an internal groove 26 at one end and an external groove 28 at the opposite end. Again the intent is to allow enough outward bending so that the tendency to bend back after swaging will be of no or little consequence as the final position of ends 30 or 32 will be such that there will be little or no end effect to reduce drift diameter after expansion.

Figure 3:
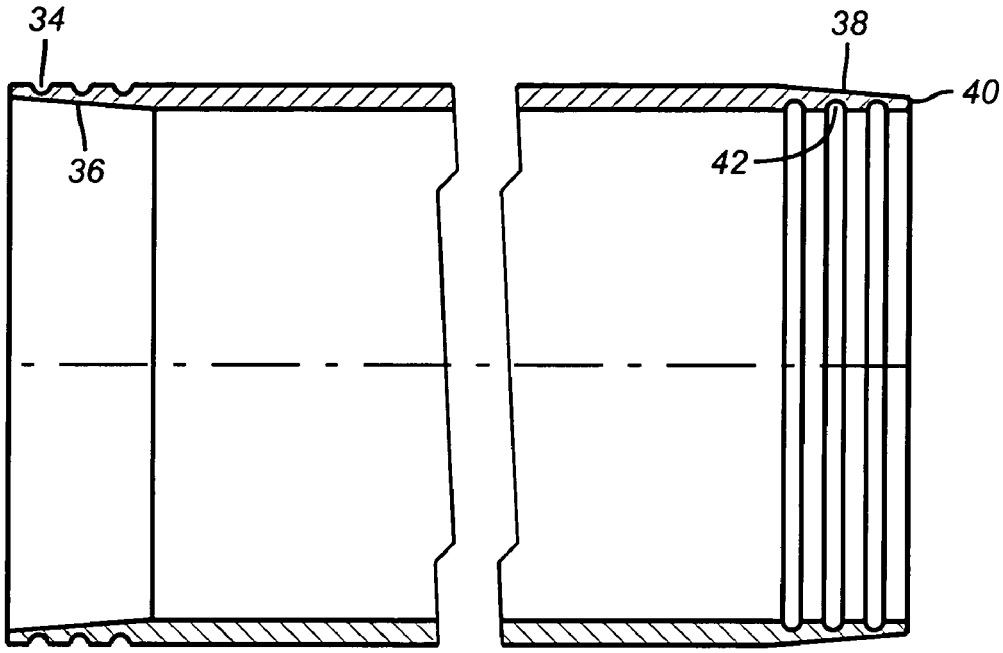
FIG. 3 shows, in section, external grooves over an internal taper at one end and external taper over internal groove at the other end.

FIG. 3 illustrates an exterior rib pattern 34 coupled with an outward sloping surface 36 on the interior opposite the rib pattern 34. At the opposite end, the pattern is reversed, with the wall taper 38 making the wall thinner going closer to end 40 while the rib pattern 42 is now on the inside opposite the wall taper 38.

Figure 4:
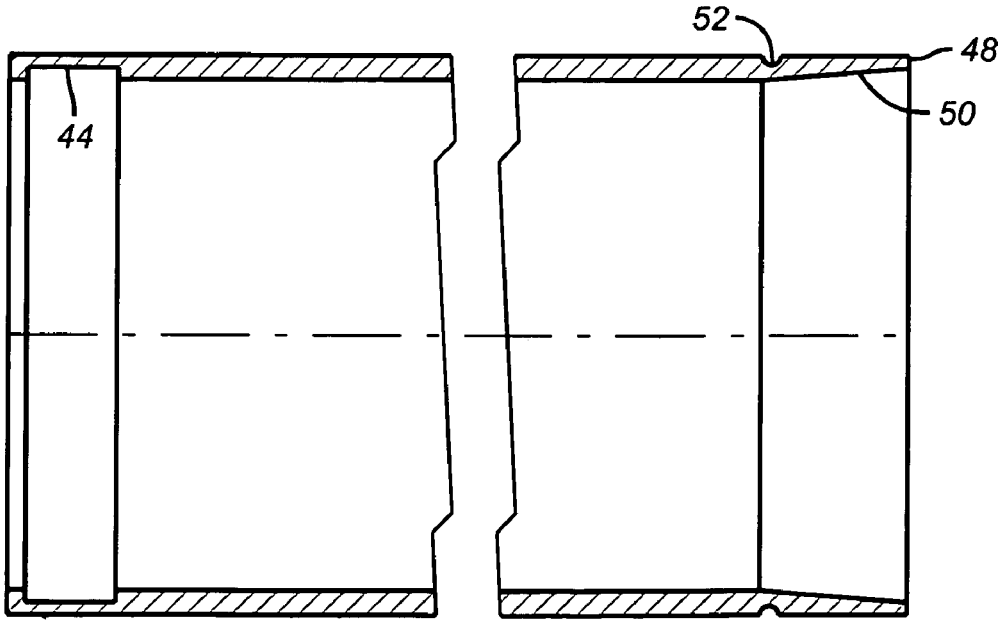
FIG. 4 shows, in section, an internal groove at one end and an external notch coupled with an internal taper at the other end.

FIG. 4 shows an internal groove 44 that does not extend to the end 46. The wall thickness decreases in the groove 44. At the opposite end 48 in an internal taper 50 that reduces the wall thickness toward the end 48. There is also an exterior circumferential notch 52.

Figure 5:
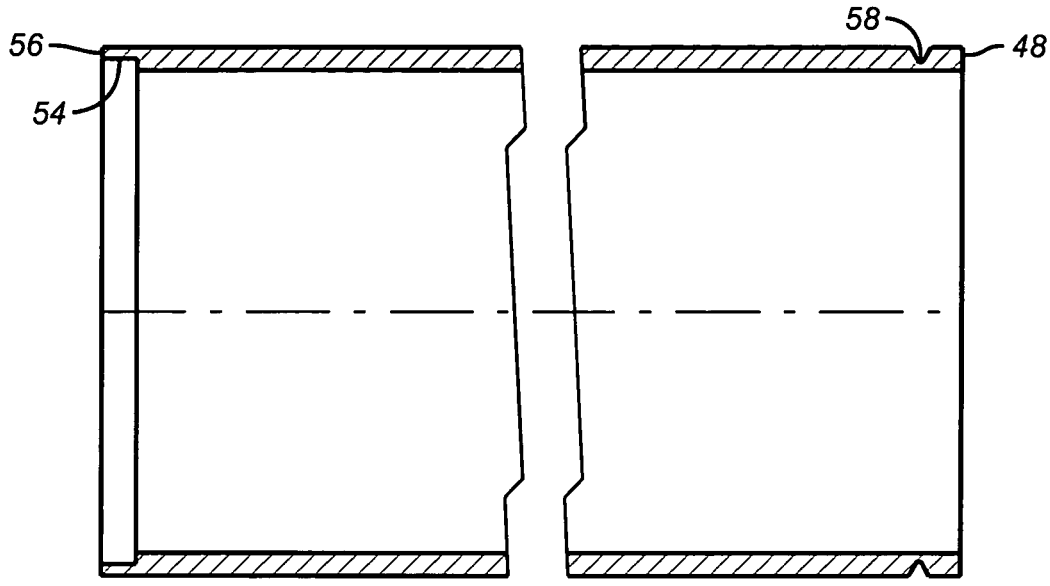
FIG. 5 shows, in section, an internal groove starting at one end and an external groove away from the opposite end.
Figure 6:
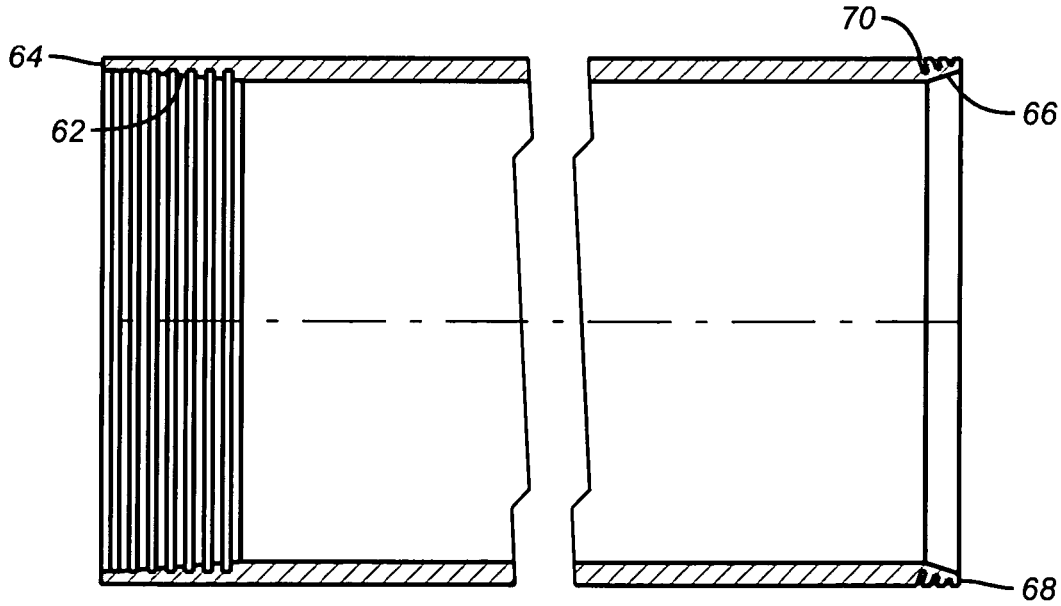
FIG. 6 shows, in section, an internal taper and series of internal grooves starting at one end and an internal taper and a series of external grooves on the opposite end.

FIG. 5 shows a short groove 54 starting from end 56 and en exterior notch 58 at end 60. FIG. 6 shows a series of ribs or a thread 62 internally near end 64 and an internal taper 66 that reduces the wall thickness toward end 68. A plurality of closely spaced ribs 70 are on the outside and perpendicular to the taper 66.

Figure 7:
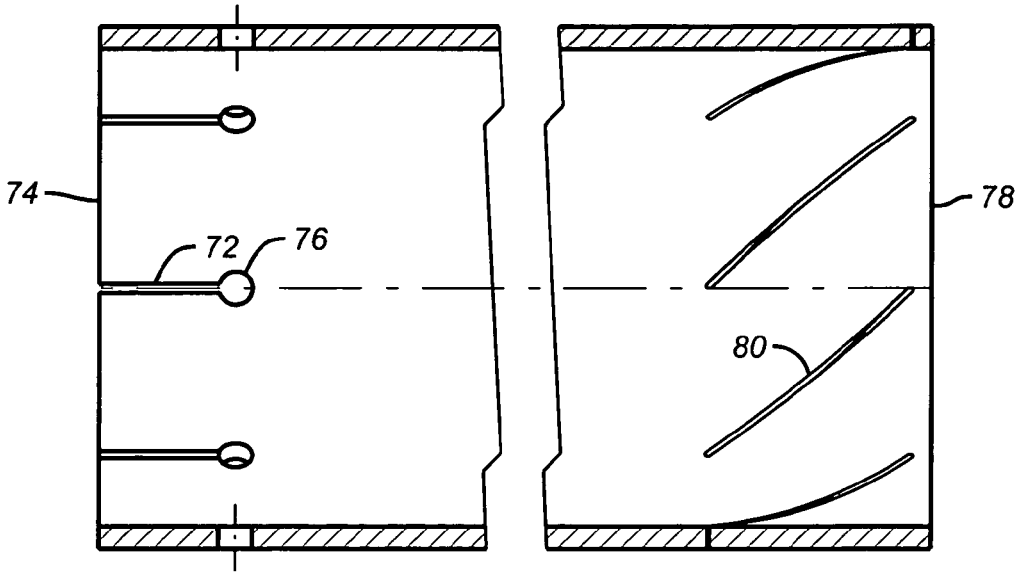
FIG. 7 shows, in section, straight slots capped with holes extending from one end and a pattern of helical slots that is located internally of the opposite end.

FIG. 7 shows slots 72 that start at end 74 and that terminate in rounded openings 76. Openings 76 can have other shapes and can be placed elsewhere along slots 72 or offset from them. At end 78 are a plurality of slots 80 that are preferably parallel to each other and disposed in a helical layout. The slots 80 need not be identical in width or length and do not have to be parallel. Also contemplated are other techniques that remove some of the wall material to weaken the ends so as to prevent or minimize the end effect due to expansion.

Figure 8:
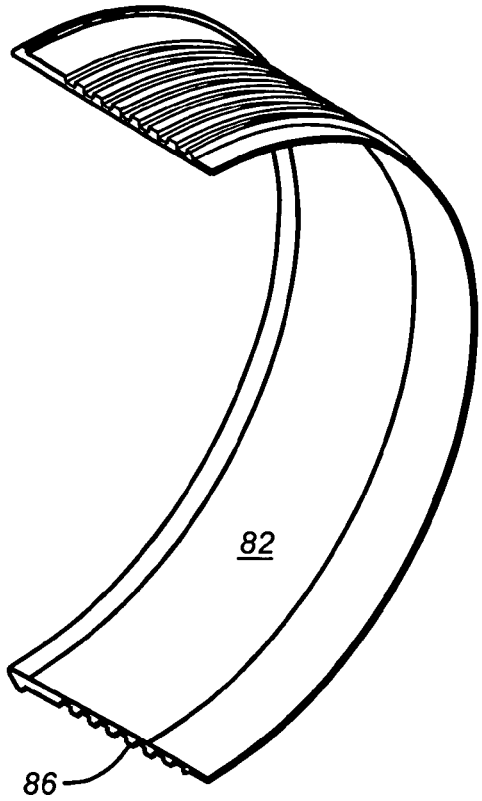
FIG. 8 is an isometric section view of an insert that can be placed in threads prior to expansion.
Figure 9:
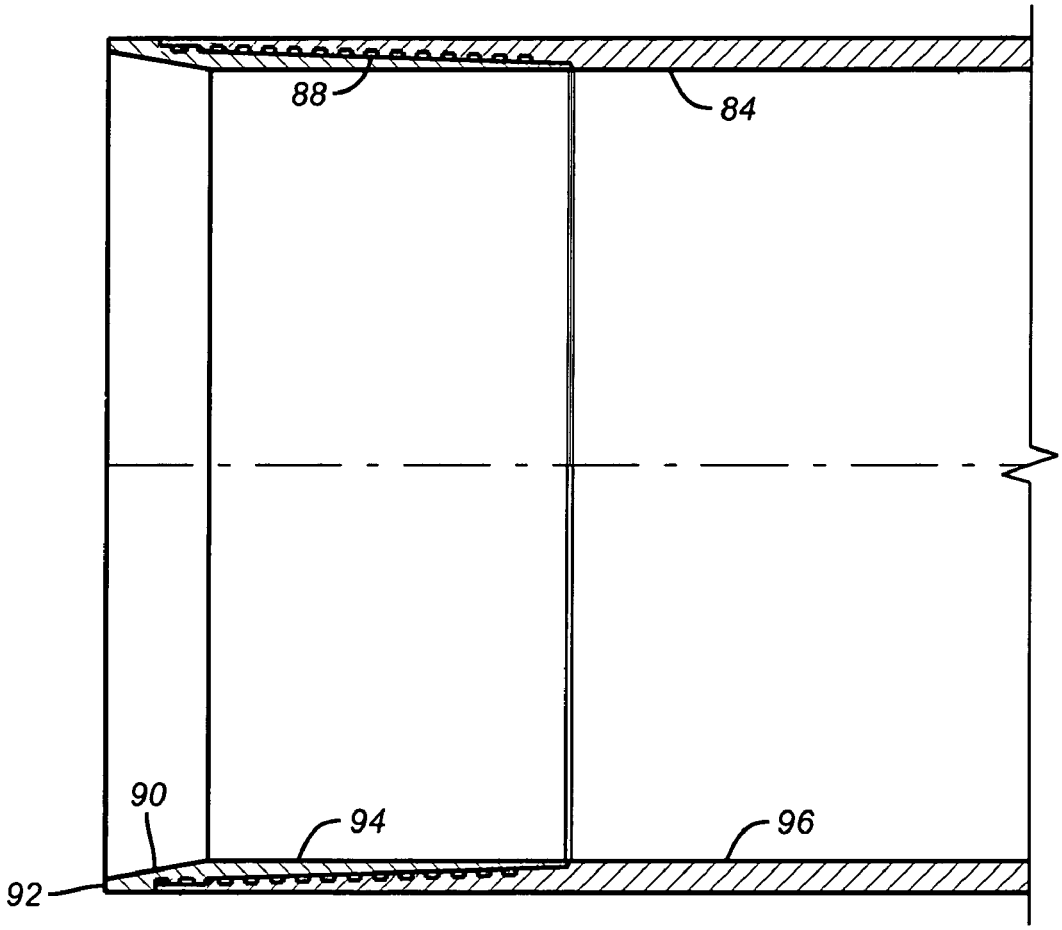
FIG. 9 is a section view showing the insert of FIG. 8 mounted to threads at one end of a tubular to be expanded.

FIGS. 8 and 9 show another approach. An insert 82 made of a softer material than the tube 84 has an exterior thread 86 to engage thread 88 on tube 84. The insert 82 is tapered 90 from end 92. It has an inner cylindrical surface 94 that can be aligned with inside wall 96 of tube 84. Alternatively surface 94 can be sloping outwardly in the same direction of taper 90 or in the opposite direction. After the swage or known expansion device (not shown) is advanced through this assembly the goal is to have only the softer insert 82 be the material that is in interference with a larger drift diameter. That way a tool can be forced through the expanded tubular and will push or form out of the way any portion of the softer insert that reduces the drift diameter of surface 84. The insert will also help to resist the inward collapse of end 92 while it is also believed that the ribs or thread 86 can also be configured to enhance outward bending during expansion to the point where the recoiling inward effect at the ends is also minimized. The insert can be copper or another pliable metal, or other soft or flowing non-metallic materials that will easily yield under the expansion pressures from swaging. The insert may also be configured with longer or shorter length than demonstrated in FIGS. 8 & 9. The insert may also be configured with a different attachment method, such as but not limited to the following: straight threads, adhesive, brazing/welding, latching mating profiles, set screws, shear screws, or bolts.

By properly configuring the end treatment that remains free during the swaging, the end effect can be reduced and even wholly made irrelevant if it does occur. Alternatively, it can be fully counteracted before the swaging such that as a result of the swaging, there is no subsequent reduction in drift diameter of the expanded tube. The outward bending shown in FIG. 1 is one approach. It compensates for the tendency to end effect so that the net result even with end effect is no or minimal reduction in drift diameter. The internal end groove 54 in FIG. 5, is another approach where even if there is an end effect, the recessed nature of the end wall makes the end result of end effect have no or minimal effect on reducing the expanded drift diameter. Alternatives with longitudinal or spiral slots such as FIG. 7 seek to reduce residual hoop stresses and, by that mechanism, combat the tendency of the ends to end effect. FIGS. 8 and 9 illustrate an approach where the insert has little, if any residual stress to resist the residual stress in the tubular outside of it so that the net result is either no reduction in post expansion drift diameter or even if there is some reduction in drift diameter, it is the insert that is soft that is in the way so that it can be pushed or formed out of the way by a subsequently advancing tool. Still other approaches to narrowing the wall thickness near the ends, such as FIG. 3, operate on the principle that hoop stresses that may reside in the tube after expansion would be minimized by the wall thickness reduction or that such accumulated residual stresses would result in longitudinal collapse or some minimal bending in the zone of reduced thickness where the impact on post-expansion drift diameter is minimized.

Figure 10:
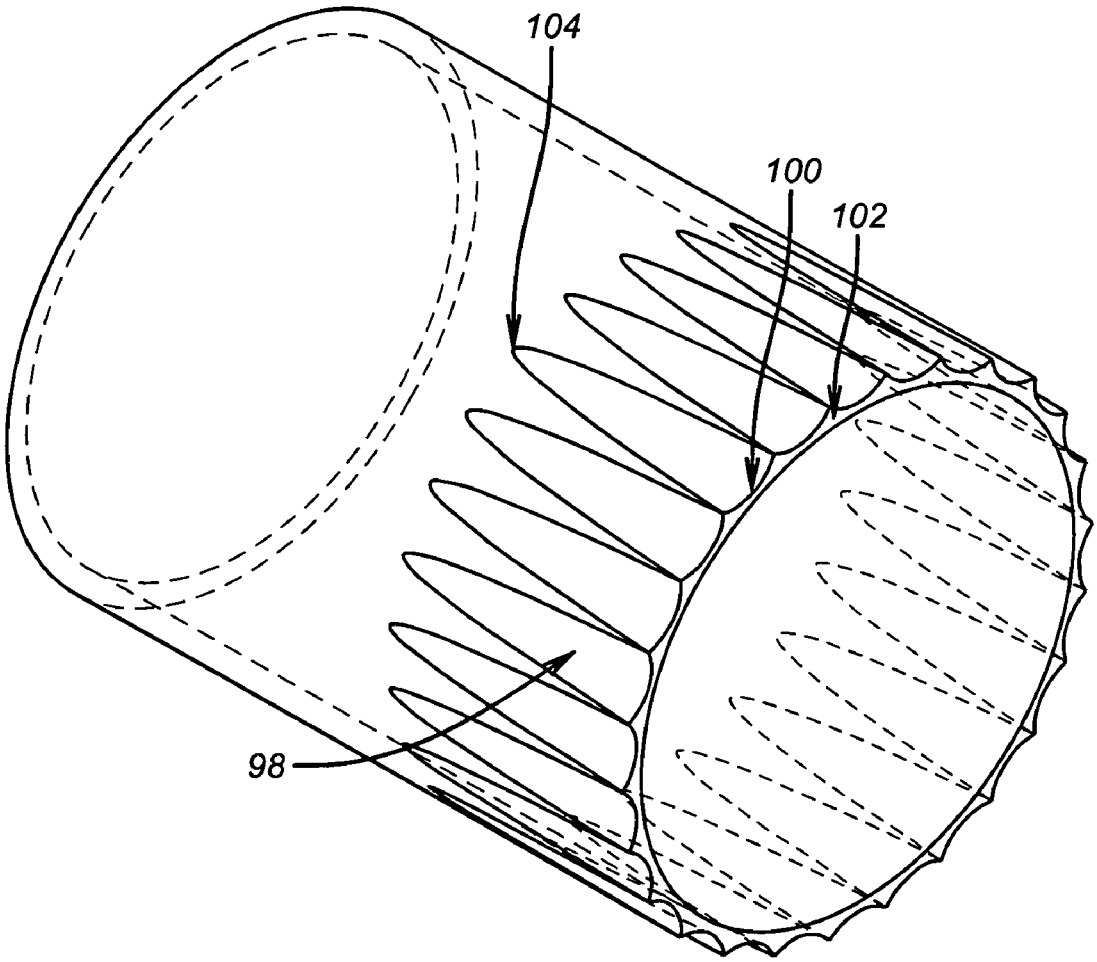
FIG. 10 shows exterior tapered longitudinal segments of removed material extending to the end of the tube.
Figure 11:
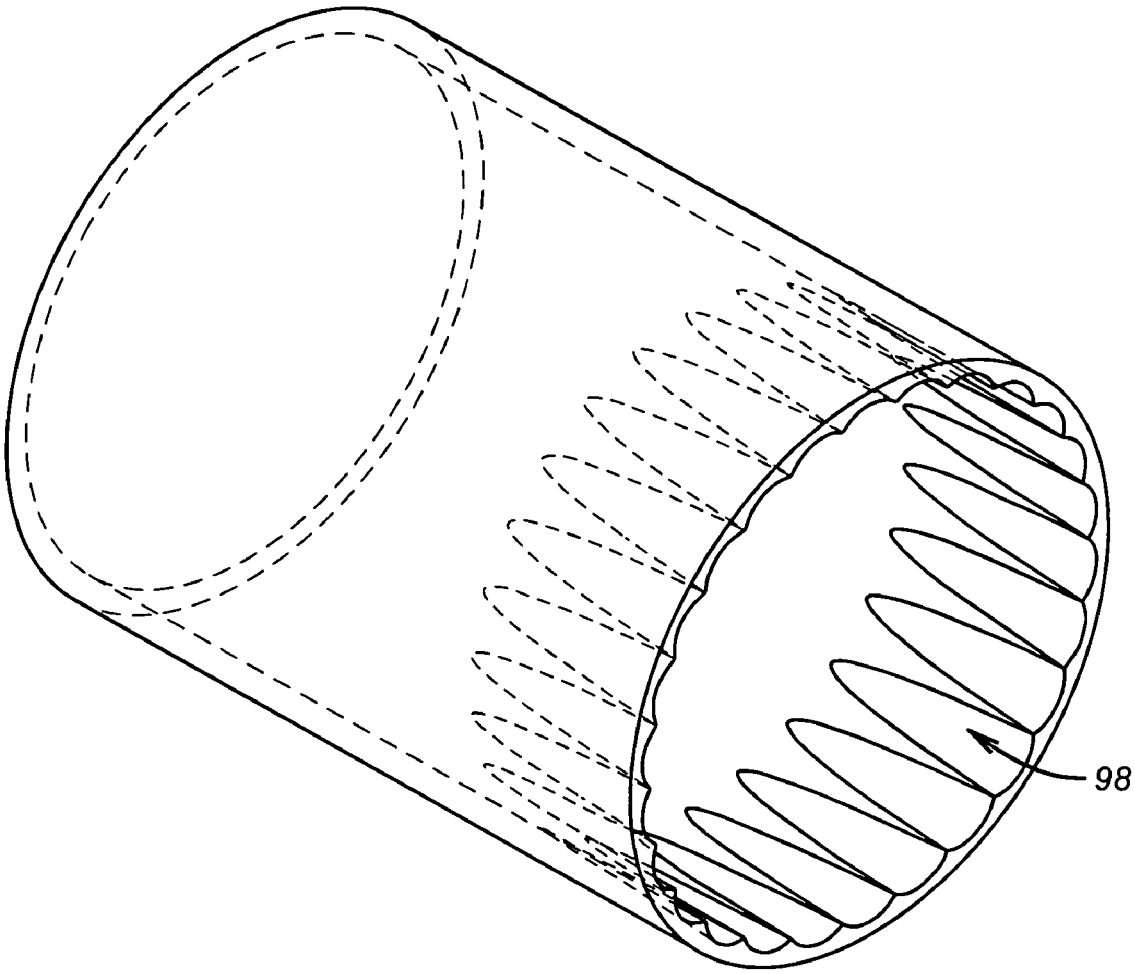
FIG. 11 is the view of FIG. 10 with the segments of removed material on the inside and extending to the end of the tubular.

FIGS. 10 and 11 show the use of removal of material in longitudinal segments 98 that have a wide dimension 100 at the end 102 and a narrow dimension 104 near the opposite end. FIG. 10 shows the segments 98 on the outside of the tubular but they can also be on the inside of the tubular, as shown in FIG. 11. The orientation can be reversed with the narrow dimension 104 being disposed near the end 102.

The foregoing disclosure and description of the invention are illustrative and explanatory thereof, and various changes in the size, shape and materials, as well as in the details of the illustrated construction, may be made without departing from the spirit of the invention.

We claim:

1. A method of expanding a tubular downhole said tubular made of a wall formed of a hard metal, comprising:

positioning an end of the hard metal tubular downhole in an overlapping relation with a surrounding tubular;

advancing an expansion device within an end of said hard metal tubular that overlaps with said surrounding tubular;

removing material from said overlapping end of said hard metal tubular, without compensating for said material removed by insertion of additional material, prior to expanding with said expansion device so as to eliminate or minimize, after expansion with said expansion device, the reduction in end drift diameter within said hard metal tubular as compared to an interior portion of said hard metal tubular.

2. A method of expanding a tubular downhole, comprising:

positioning the tubular downhole advancing an expansion device toward an end of a tubular;

configuring at least one end of the tubular so as to eliminate or minimize, after expansion with said expansion device, the reduction in end drift diameter as compared to an interior portion of the tube for the tube;

providing an insert adjacent an end of said tubular that will hold less residual hoop stress after expansion than the surrounding portion of said tubular.

3. The method of claim 2, comprising:

making said insert softer than the surrounding tubular.

4. The method of claim 2, comprising:

providing a plurality of openings adjacent said end of said tubular having said insert before advancing the expansion device through said end;

reducing, with said openings, residual hoop stress in said end of said tubular, after said advancing the expansion device.

5. The method of claim 4, comprising:

providing longitudinally oriented slots as said openings.

6. A method of expanding a tubular downhole, comprising:

positioning the tubular downhole advancing an expansion device toward an end of a tubular;

configuring at least one end of the tubular so as to eliminate or minimize, after expansion with said expansion device, the reduction in end drift diameter as compared to an interior portion of the tube for the tube;

providing an insert adjacent an end of said tubular that will hold less residual hoop stress after expansion than the surrounding portion of said tubular;

making said insert softer than the surrounding tubular;

connecting said insert to said tubular by at least one technique of threading, brazing, applying adhesive, setscrew, shear screw, bolting and latching mating profiles.

7. A method of expanding a tubular downhole, comprising:

positioning the tubular downhole advancing an expansion device toward an end of a tubular;

configuring at least one end of the tubular so as to eliminate or minimize, after expansion with said expansion device, the reduction in end drift diameter as compared to an interior portion of the tube for the tube;

providing an insert adjacent an end of said tubular that will hold less residual hoop stress after expansion than the surrounding portion of said tubular;

disposing only said insert in a reduced drift diameter portion near said end of said tubular after expansion with said expansion device;

advancing a full drift tool into said tubular;

removing at least a portion of said insert with said tool to allow it to pass said reduced drift diameter end.

8. A method of expanding a tubular downhole, comprising:

positioning the tubular downhole advancing an expansion device toward an end of a tubular;

configuring at least one end of the tubular so as to eliminate or minimize, after expansion with said expansion device, the reduction in end drift diameter as compared to an interior portion of the tube for the tube;

providing an insert adjacent an end of said tubular that will hold less residual hoop stress after expansion than the surrounding portion of said tubular;

pre-bending said end of the tubular adjacent said insert away from a central axis of the tubular before advancing the expansion device through said end.

9. A method of expanding a tubular downhole, comprising:

positioning the tubular downhole advancing an expansion device toward an end of a tubular;

configuring at least one end of the tubular so as to eliminate or minimize, after expansion with said expansion device, the reduction in end drift diameter as compared to an interior portion of the tube for the tube;

providing an insert adjacent an end of said tubular that will hold less residual hoop stress after expansion than the surrounding portion of said tubular;

providing a plurality of openings adjacent said end of said tubular having said insert before advancing the expansion device through said end;

reducing, with said openings, residual hoop stress in said end of said tubular, after said advancing the expansion device;

providing spirally wound slots as said openings.

10. The method of claim 9, comprising:

terminating at least one of said slots short of either end of the tubular.

11. A method of expanding a tubular downhole, comprising:

positioning the tubular downhole advancing an expansion device toward an end of a tubular;

configuring at least one end of the tubular so as to eliminate or minimize, after expansion with said expansion device, the reduction in end drift diameter as compared to an interior portion of the tube for the tube;

providing an insert adjacent an end of said tubular that will hold less residual hoop stress after expansion than the surrounding portion of said tubular;

providing a plurality of openings adjacent said end of said tubular having said insert before advancing the expansion device through said end;

reducing, with said openings, residual hoop stress in said end of said tubular, after said advancing the expansion device;

providing longitudinally oriented slots as said openings;

allowing said slots to extend to the end of said tubular;

terminating at least one of said slots in the interior of the tubular with a different shaped opening.

12. A method of expanding a tubular downhole, comprising:

positioning the tubular downhole advancing an expansion device toward an end of a tubular;

configuring at least one end of the tubular so as to eliminate or minimize, after expansion with said expansion device, the reduction in end drift diameter as compared to an interior portion of the tube for the tube;

providing an insert adjacent an end of said tubular that will hold less residual hoop stress after expansion than the surrounding portion of said tubular;

providing one of an internal groove of constant diameter to the end of said tubular and an internal taper of increasing diameter extending toward the end of said tubular, before advancing the expansion device through said end.

13. A method of expanding a tubular downhole, comprising:

positioning the tubular downhole advancing an expansion device toward an end of a tubular;

configuring at least one end of the tubular so as to eliminate or minimize, after expansion with said expansion device, the reduction in end drift diameter as compared to an interior portion of the tube for the tube;

providing an insert adjacent an end of said tubular that will hold less residual hoop stress after expansion than the surrounding portion of said tubular;

providing one of at least one internal and external groove on the tubular with said groove not extending to the end of the tubular.

14. A method of expanding a tubular downhole, comprising:

positioning the tubular downhole advancing an expansion device toward an end of a tubular;

configuring at least one end of the tubular so as to eliminate or minimize, after expansion with said expansion device, the reduction in end drift diameter as compared to an interior portion of the tube for the tube;

providing an insert adjacent an end of said tubular that will hold less residual hoop stress after expansion than the surrounding portion of said tubular;

providing an external groove extending to the end of said tubular;

bending said end of the tubular away from the centerline of the tubular, before advancing the expansion device through said end, to create a taper that increases in diameter on approaching the end of said tubular.

15. A method of expanding a tubular downhole, comprising:

positioning the tubular downhole advancing an expansion device toward an end of a tubular;

configuring at least one end of the tubular so as to eliminate or minimize, after expansion with said expansion device, the reduction in end drift diameter as compared to an interior portion of the tube for the tube;

pre-bending said end of the tubular adjacent an insert away from a central axis of the tubular before advancing the expansion device through said end.

16. A method of expanding a tubular downhole, comprising:

positioning the tubular downhole advancing an expansion device toward an end of a tubular;

configuring at least one end of the tubular so as to eliminate or minimize, after expansion with said expansion device, the reduction in end drift diameter as compared to an interior portion of the tube for the tube;

providing a plurality of openings adjacent said end of said tubular having an insert before advancing the expansion device through said end;

reducing residual hoop stress in said end of said tubular, after expanding, with said openings.

17. The method of claim 16, comprising:

providing longitudinally oriented slots as said openings.

18. A method of expanding a tubular downhole, comprising:

positioning the tubular downhole advancing an expansion device toward an end of a tubular;

configuring at least one end of the tubular so as to eliminate or minimize, after expansion with said expansion device, the reduction in end drift diameter as compared to an interior portion of the tube for the tube;

providing a plurality of openings adjacent said end of said tubular having an insert before advancing the expansion device through said end;

reducing residual hoop stress in said end of said tubular, after expanding, with said openings;

providing spirally wound slots as said openings.

19. The method of claim 18, comprising:

terminating at least one of said slots short of either end of the tubular.

20. A method of expanding a tubular downhole, comprising:

positioning the tubular downhole advancing an expansion device toward an end of a tubular;

configuring at least one end of the tubular so as to eliminate or minimize, after expansion with said expansion device, the reduction in end drift diameter as compared to an interior portion of the tube for the tube;

providing a plurality of openings adjacent said end of said tubular having an insert before advancing the expansion device through said end;

reducing residual hoop stress in said end of said tubular, after expanding, with said openings;

providing longitudinally oriented slots as said openings;

allowing said slots to extend to the end of said tubular;

terminating at least one of said slots in the interior of the tubular with a different shaped opening.

21. A method of expanding a tubular downhole said tubular made of a wall formed of a hard metal, comprising:

positioning the hard metal tubular downhole in an overlapping relation with a surrounding tubular;

advancing an expansion device within an end of a said hard metal tubular that overlaps with said surrounding tubular;

weakening said overlapping end of said hard metal tubular prior to expanding with said expansion device so as to eliminate or minimize, after expansion with said expansion device, the reduction in end drift diameter within said hard metal tubular as compared to an interior portion of said hard metal tubular;

providing one of an empty internal groove of constant diameter to the end of said hard metal tubular and an internal taper of increasing diameter extending to the end of said hard metal tubular, before advancing the expansion device through said end.

22. A method of expanding a tubular downhole said tubular made of a wall formed of a hard metal, comprising:

positioning an end of the hard metal tubular downhole in an overlapping relation with a surrounding tubular;

advancing an expansion device within an end of said hard metal tubular that overlaps with said surrounding tubular;

weakening said overlapping end of said hard metal tubular prior to expanding with said expansion device so as to eliminate or minimize, after expansion with said expansion device, the reduction in end drift diameter within said hard metal tubular as compared to an interior portion of said hard metal tubular;

providing one of at least one internal and external empty groove on the hard metal tubular with said groove not extending to the end of the hard metal tubular.

23. A method of expanding a tubular downhole, comprising:

positioning the tubular downhole;

advancing an expansion device toward an end of a tubular;

configuring at least one end of the tubular so as to eliminate or minimize, after expansion with said expansion device, the reduction in end drift diameter as compared to an interior portion of the tube for the tube;

providing an external groove extending to the end of said tubular;

bending said end of the tubular away from the centerline of the tubular, before advancing the expansion device through said end, to create a taper that increases in diameter on approaching the end of said tubular.

24. A method of expanding a plain end tubular downhole said tubular made of a wall formed of a hard metal, comprising:

positioning an end of the hard metal tubular downhole in an overlapping relation with a surrounding tubular;

advancing an expansion device within an end of a said hard metal tubular that overlaps with said surrounding tubular;

weakening said overlapping end of said hard metal tubular prior to expanding with said expansion device so as to eliminate or minimize, after expansion with said expansion device, the reduction in end drift diameter within said hard metal tubular as compared to an interior portion of said hard metal tubular;

providing a plurality of segments of removed material generally longitudinally oriented that thin the wall of the tubular adjacent said overlapping end thereof.

25. A method of expanding a tubular downhole, comprising:

positioning the tubular downhole advancing an expansion device toward an end of a tubular;

configuring at least one end of the tubular so as to eliminate or minimize, after expansion with said expansion device, the reduction in end drift diameter as compared to an interior portion of the tube for the tube;

providing a plurality of segments of removed material that thins the wall of the tubular adjacent an end thereof;

providing a taper on said segments;

aligning said segments longitudinally on the tubular.

26. The method of claim 25, comprising:

providing said segments on at least one of the inside and the outside of the tubular;

orienting a wide portion of said segments nearest an end of said tubular.

* * * * *